US006378799B1

(12) United States Patent
Gambini

(10) Patent No.: US 6,378,799 B1
(45) Date of Patent: Apr. 30, 2002

(54) DEVICE FOR CONTROLLING WINDING OF A LOG IN A RE-REELING MACHINE

(76) Inventor: Giovanni Gambini, Via A. Omodeo 7, I - 56100 Pisa (IT)

( * ) Notice: Subject to any disclaimer, the term of this patent is extended or adjusted under 35 U.S.C. 154(b) by 4 days.

(21) Appl. No.: 09/688,591

(22) Filed: Oct. 16, 2000

(30) Foreign Application Priority Data

Oct. 18, 1999 (IT) ..... MI99A2172

(51) Int. Cl.[7] ..... B65H 18/14; B65H 67/00
(52) U.S. Cl. ..... 242/541.6; 242/533
(58) Field of Search ..... 242/390, 533, 242/541, 541.1, 541.2, 541.4, 541.5, 541.6

(56) References Cited

U.S. PATENT DOCUMENTS

| | | | | |
|---|---|---|---|---|
| 2,613,043 A | * | 10/1952 | Kmentt | 242/66 |
| 3,345,010 A | * | 10/1967 | Egan | 242/66 |
| 3,822,836 A | * | 7/1974 | Troyer et al. | 242/66 |
| 4,883,233 A | * | 11/1989 | Saukkonen et al. | 242/66 |
| 5,067,663 A | * | 11/1991 | Dropczynski | 242/56 R |
| 5,165,618 A | | 11/1992 | Ruff | |
| 5,639,046 A | * | 6/1997 | Biagiotti | 242/541.2 |

FOREIGN PATENT DOCUMENTS

| | | |
|---|---|---|
| EP | 0326528 | 8/1989 |

* cited by examiner

*Primary Examiner*—Donald P. Walsh
(74) *Attorney, Agent, or Firm*—Hedman & Costigan, P.C.

(57) ABSTRACT

A device for controlling winding of a roll of paper or "log" in a re-reeling machine comprising, on a roll stand or frame (20), a set of three rollers arranged with their axes parallel to one another and perpendicular to the direction of feed of the paper, comprising two winding rollers (15, 16), a top one (15) and a bottom one (16), designed to co-operate with a third roller (17) which exerts a certain pressure on a roll of paper or log being formed, the first two rollers (15, 16) being supported on the frame (20), and the third roller (17) being carried by a pair of arms (21) that are free to oscillate with respect to the frame (20), the paper being wound passing over one of the two rollers (15, 16), and the finished roll (14) coming out of an output gap (43) identified between the bottom roller (15) and the third roller (17), in which the third roller (17) and the pair of arms (21) are set on a moving element (24) displaceable according to a direction (28) oscillating within an angle ($\alpha$) with respect to a direction parallel to a direction of growth (29) of the roll being formed.

12 Claims, 2 Drawing Sheets

DEVICE FOR CONTROLLING WINDING OF A LOG IN A RE-REELING MACHINE

Figure 1:
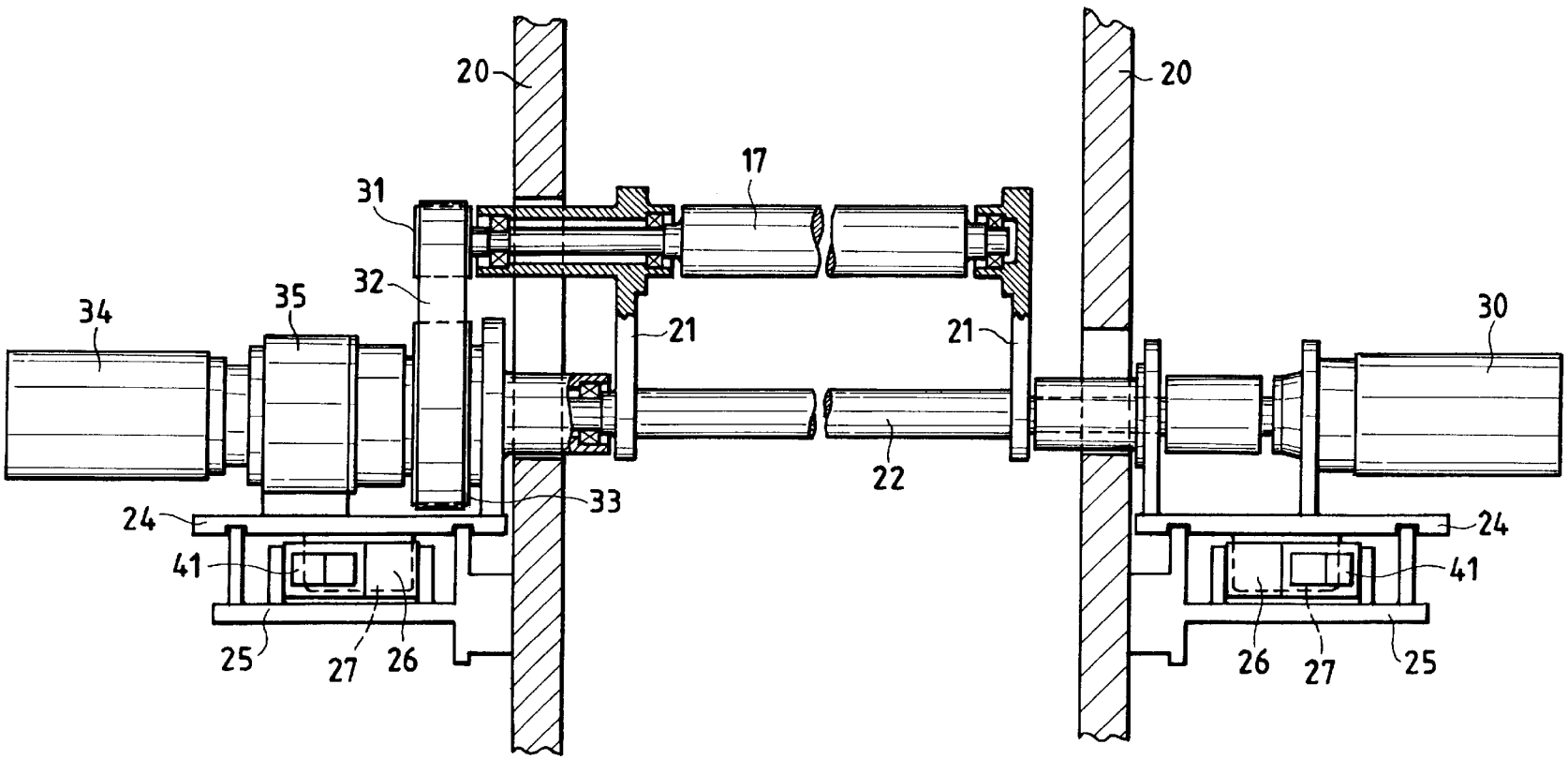

The present invention refers to a device for controlling winding of a log in a re-reeling machine.

In machines or assemblies for winding paper for household use, such as toilet paper, absorbent wipes, towelettes, serviettes, handkerchiefs and the like, elements are provided which guide the paper being fed and control proper winding thereof on a central core, or in any case winding thereof to form a finished roll of pre-set size even without a core, the said roll usually being referred to as "log".

It is known that in these machines, the so-called re-reeling machines, designed to form the aforesaid rolls of paper or logs, are generally provided with two winding rollers designed to co-operate with a third roller. The first two rollers simply determine winding of the paper into a roll progressively increasing in diameter, whilst the third roller, in addition to co-operating with the winding operation, has the function of exerting a certain pressure on the roll or log, ensuring the required compacted winding of the latter.

The first two rollers have a fixed position with respect to the outer frame and contribute to supporting the log and to drawing the paper through. The third roller, acting as a pressure roller, exerts a pressure on the log being formed, and hence determines the diameter of the finished product.

In order to do this, the third roller, generally referred to as "pressure roller" is supported on opposite ends of at least one pair of arms pivoted to the frame. The third roller is thus free to oscillate according to a curved direction about the pivoting of the arms, and the pressure acting on the roller can be controlled by means of a sensor.

For the winding to be of good quality, the finished roll of paper must be contained between the three rollers, and the output gap from the above-mentioned arrangement of three rollers for winding the roll must be slightly smaller than the diameter of the finished log.

This arrangement is necessary for ensuring that, during output, the log or roll of paper will undergo a slight squeezing such as to guarantee contact with the third roller or pressure roller throughout the exchange stage (i.e., end of log, ejection of finished log, and start of winding of subsequent log).

This fairly precise sizing of the output gap is rather important in so far as if the gap were too narrow, the squeeze would be excessive, with consequent ovalization of the finished product. In the case of a gap that is too large, even though the squeeze would be reduced, there might occur a loss of contact between the winding pressure roller and the log, with possible exit of the latter from the set of three rollers before winding is completed.

In addition, the fact should be considered that, with the arrangement of three rollers currently in use, control and containment of the log is increasingly more difficult as the diameter of the finished product increases. In fact, the known arrangement in general enables a good quality of winding up to diameters of the finished product of around 110 mm, and not more.

A purpose of the present invention is therefore to provide a device for controlling winding of a log in a re-reeling machine which will overcome the drawbacks referred to above, working in a highly satisfactory way even as the diameter of the roll varies.

Another purpose of the present invention is to have available a device which, albeit enabling optimal output of the roll with minimal squeeze, works efficiently also for roll diameters exceeding 110 mm.

Yet another purpose of the present invention is to provide a device which, albeit overcoming the drawbacks referred to previously, makes it possible even so to obtain minimal squeezing of the finished roll, within the tolerances according to the requirements.

These purposes according to the present invention are achieved by providing a device for controlling winding of a log in a paper re-reeling machine, as specified in claim 1.

Further, more detailed, characteristics are specified in the subsequent claims.

Figure 2:
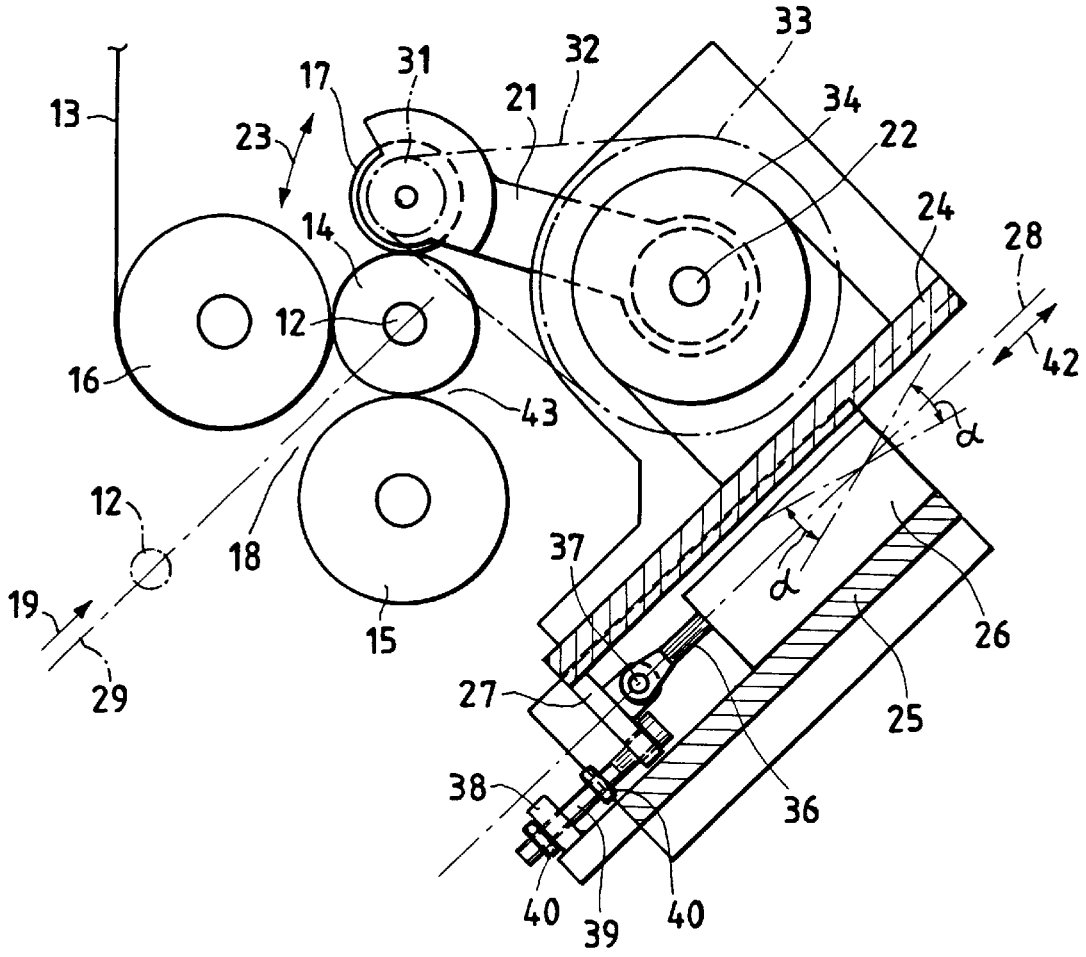

The characteristics and advantages of a device for controlling winding of a log in a paper re-reeling machine will emerge more clearly evident from the ensuing description, which is provided purely to furnish an explanatory and non-limiting example, with reference to the attached schematic drawings in which:

FIG. 1 is a partial and sectional front view of a device for controlling a log in a re-reeling machine, made according to the invention; and FIG. 2 is a schematic elevation of a device for controlling winding of a log in a re-reeling machine, made according to the invention, with the log almost finished and completely wound; there being shown, in the said elevation, exclusively the support of a slide.

With reference to the figures in general, shown therein is a central part of a machine for winding paper, in particular paper to be subsequently used as toilet paper, absorbent paper, serviettes, handkerchiefs and the like, on a central tubular core 12, the paper being fed into the machine in a known way.

The tubular core 12, which arrives from a magazine (not shown), is introduced inside an arrangement or set of three rollers which guide an incoming continuous ribbon of paper 13 and control proper winding thereof on the aforesaid core 12 to obtain a finished roll, of pre-set size, usually referred to as "log", and designated by 14. It is to be noted that the said roll 14 may also be without a core and be simply wound directly from the incoming continuous ribbon of paper within the set of three rolls.

The incoming ribbon of paper 13 is generally paper consisting of one or more combined ribbons, once they have been unwound from their respective rolls (not shown).

The arrangement of three rollers, the axes of which are parallel to one another and perpendicular to the direction of feed of the paper, generally comprises two winding rollers 15 and 16 designed to co-operate with a third roller 17.

The first two rollers 15 and 16, which rotate on axes that are fixed with respect to a frame 20 of the machine (shown only in part) determine, between them, an input gap 18. The input gap 18 is used for receiving the aforesaid core 12, which is introduced according the direction indicated by the arrow 19.

In addition to co-operating with the first two rollers 15 and 16 in winding the paper, the third roller 17 has the function of maintaining a certain pressure on the roll or log 14 being formed, in order to control proper compacted winding of the latter.

In fact, the third roller 17, which, as has been said, is referred to as "pressure roller", is generally supported on opposite ends of at least one pair of arms, represented schematically and designated by 21 and pivoted, by means of a shaft 22, to the frame 20. The third roller 17 is thus free to oscillate according to a curved path, indicated by the double-headed arrow 23, about the shaft 22 for pivoting the arms 21, and the pressure acting on it may be controlled by means of a sensor or a similar element (not shown).

More precisely, according to the present invention, the shaft 22 is supported, at its opposite ends, on a moving element, shown schematically as a pair of slides 24, for example sliding on supports 25 which extend from the side supports or shoulders forming part of the frame 20. Translation of the two slides 24 is by means of a pair of cylinders 26 which act on appendages 27 of the slides 24, which are facing downwards.

It should be noted that the cylinders 26 and slides 24 are oriented according to a direction indicated by an axis 28 which is parallel to a direction of growth of the roll 14, indicated by an axis 29.

It may thus be observed that this third roller 17, acting as a pressure roller, exerts a pressure on the log or roll 14 being formed, thus determining the diameter of the finished product, in that the roller 17 performs two different movements that may be connected and combined together.

The direction of movement of the moving element may also be oscillated within an angle $\alpha$ of approximately 30° (+15°/−15°) with respect to the direction of the axis 28, without thereby departing from the scope of the present invention.

The third roller 17 performs in fact a rotational motion about the pivoting shaft 22 and a translational motion in a direction parallel to or slightly inclined with respect to that of the axis 28.

The pressure exerted on the roll 14 may thus be maintained constant as the diameter of said roll 14 varies, it being also possible to move away the centre of rotation of the third roller 17. In this way, the correct winding pressure is maintained, and consequently squeezing of the roll is controlled thanks to the degree of displacement of the moving element, represented, in the example, by the cylinder 26.

The possibility of dosing the pressure and controlling squeezing and containment of the roll between the three rollers 15, 16 and 17 enables a good-quality roll 14 to be obtained regardless of the final diameter of the roll.

In the example, a motor 30 is shown which is carried by one of the slides 24 and which determines rotation, according to a clockwise and counterclockwise oscillating motion, of the shaft 22, to which are fixed the arms 21 that carry the roller 17 so that the latter can turn.

At one end, the roller 17 moreover carries, fixed to it, a pulley 31, which is operated by a drive member 32, such as a drive belt, controlled by a further pulley 33. The latter pulley 33 is driven in rotation by a motor 34 with interposition of a differential 35. Also in this case, both the motor 34 and the differential 35 are set above a second slide 24, actuated in the manner described previously.

FIG. 2 shows more clearly the detail of the coupling between the slide 24 and the support 25. It also shows how from each cylinder 26 there comes out a stem 36 which engages, by means of a pin 37, the respective appendage 27. It is possible to adjust the position of end of travel of the latter appendage 27 with respect to a detent element 38 by means of a threaded rod 39 and interposed nuts 40.

In this way, it is possible to predetermine the maximum travel of the cylinders 26 and the maximum travel of the slides 24, i.e., the maximum extent of sliding of the pivoting shaft 22 about which the pressure roller 17 oscillates.

In addition, associated to each of the cylinders is an adjustment assembly, designated by 41, which has the function of a limiter or restricting element for the cylinder 26.

The presence of the moving element, which moves forwards and backwards as indicated by the arrow 42 and which carries the supports of the pivoting shaft 22 and of the pressure roller 17, determines the possibility for the pressure roller to follow the axis of growth 29 of the roll, so preventing squeezing of the latter and solving the problems referred to previously.

Of course, in order to prevent the roll that is being formed from coming out from this configuration of three rollers for winding of the roll, it is evident that the output gap, designated by 43, must be slightly smaller than the diameter of the finished log 14. In other words, the roll being formed must be kept either slightly set back with respect to said output gap within the area between the three rollers or anyway said gap must never be larger than the diameter of the roll; otherwise, the roll will be ejected before it is finished.

The purpose of the above measures is to achieve good quality of winding and to ensure that the roll can be ejected from within the configuration constituted by the set of three rollers only when it is actually finished, whilst, at the same time, a new roll starts to be wound.

The possibility, afforded by the present invention, of displacing the pivoting of the pressure roller 17 during the phase of formation and growth of the roll enables the formation also of rolls having diameters greater than 110 mm, for instance 160 mm and even larger.

The particular structure of the device according to the present invention inserted in a machine designed to form rolls of paper, as has been said previously, thus makes possible maximum operativeness combined with minimum squeezing of the roll.

Furthermore, it is possible to eliminate defects in the rolls formed, even though these have diameters that are particularly large with respect to the usual ones, as has been said previously.

This is a device which proves extremely effective and useful in the sector of surface processing of paper, in particular, in the winding of toilet paper, wipes, towelettes, serviettes, handkerchiefs and the like, where the quantities to be processed are particularly large.

It is evident that the embodiment illustrated herein is only one of the possible embodiments, it likewise being clear that similar arrangements that use the same new and original principle are to be understood as being included in the sphere of protection of the present invention.

For instance, the displacement of the moving element backwards and forwards may be obtained not only by means of pneumatic cylinders but also by means of hydraulic cylinders or by means of external thread—internal thread assemblies driven by reversible motors. Furthermore, the translation of the slides 24 on the corresponding supports 25 can be obtained with the interposition of a ballscrew assembly or anyway a linear-sliding assembly.

The present device proves particularly useful for winding rollers 15 and 16 of limited diameters, in which the displacement of the moving element guarantees proper winding. In the presence of rollers of large diameter, like the ones used in previous machines, this advantage diminishes.

It may thus be understood how it is, in any case, possible to identify further embodiments, all of which fall within the same innovative idea of the present invention.

What is claimed is:

1. A device for controlling winding of a roll of paper or "log" in a re-reeling machine comprising, on a frame (20), a set of three rollers arranged with their axes parallel to one another and perpendicular to the direction of feed of the paper, comprising two winding rollers (15, 16), a top one (15) and a bottom one (16), designed to co-operate with a third roller (17) which exerts a certain pressure on a roll of paper or log being formed, the first two rollers (15, 16) being supported on the frame (20), and the third roller (17) being carried by a pair of arms (21) that are free to oscillate with respect to the frame (20), the paper being wound passing over one of the two rollers (15, 16), and the finished roll (14) coming out of an output gap (43) identified between the bottom roller (15) and the third roller (17), characterized in that the third roller (17) and the pair of arms (21) are set on a moving element (24) displaceable according to a direction (28) oscillating within an angle ($\alpha$) with respect to a direction parallel to a direction of growth (29) of the roll being formed.

2. A device according to claim 1, characterized in that said moving element (24) is displaceable according to a direction (28) parallel to a direction of growth (29) of the roll being formed.

3. A device according to claim 1, characterized in that said moving element (24) is fixed to at least one actuator (26) in turn fixed to said frame (20).

4. A device according to claim 1, characterized in that said third roller (17) is driven in rotation by a motor (34) supported on said frame (20), a drive (31, 32, 33) being provided set between said third roller (17) and said motor (34).

5. A device according to claim 1, characterized in that said moving element comprises a pair of slides set on opposite sides externally with respect to shoulders forming part of said frame (20) and sliding on supports (25), each support (25) carrying an actuator (26) for displacement backwards and forwards of said moving element.

6. A device according to claim 2, characterized in that said at least one actuator consists of a pneumatic cylinder (26) connected to an adjustment assembly (41).

7. A device according to claim 1, characterized in that to said moving element is associated a regulator of its travel (38, 39, 40).

8. A device according to claim 1, characterized in that said oscillating arms (21) are driven in clockwise and counter-clockwise oscillating motion by a further motor (30) combined to a pivoting shaft (22) of said arms (21).

9. A device according to claim 1, characterized in that said output gap (43) from said arrangement of three rollers is slightly smaller than that of a finished roll (14).

10. A device according to claim 1, characterized in that said roll being formed may have an internal core (12) or may not have an internal core.

11. A device according to claim 1, characterized in that said angle ($\alpha$) with respect to a direction parallel to a direction of growth (29) of the roll being formed is preferably about 30°.

12. A device according to claim 1, characterized in that said two winding rollers, one top one (15) and one bottom one (16), are of limited diameter.

* * * * *